US011854725B2

(12) United States Patent
Kuroda et al.

(10) Patent No.: US 11,854,725 B2
(45) Date of Patent: Dec. 26, 2023

(54) SOFT MAGNETIC METAL POWDER, METHOD FOR PRODUCING THE SAME, AND SOFT MAGNETIC METAL DUST CORE

(71) Applicant: TDK CORPORATION, Tokyo (JP)

(72) Inventors: Tomofumi Kuroda, Tokyo (JP); Yu Sakurai, Tokyo (JP); Tomohisa Mitose, Tokyo (JP)

(73) Assignee: TDK CORPORATION, Tokyo (JP)

( * ) Notice: Subject to any disclaimer, the term of this patent is extended or adjusted under 35 U.S.C. 154(b) by 1232 days.

(21) Appl. No.: 16/189,725

(22) Filed: Nov. 13, 2018

(65) Prior Publication Data

US 2019/0148044 A1 May 16, 2019

(30) Foreign Application Priority Data

Nov. 16, 2017 (JP) ..... 2017-220706
Sep. 10, 2018 (JP) ..... 2018-168892

(51) Int. Cl.
*H01F 1/147* (2006.01)
*C22C 38/02* (2006.01)
(Continued)

(52) U.S. Cl.
CPC ..... *H01F 1/14766* (2013.01); *B22F 1/065* (2022.01); *B22F 1/142* (2022.01);
(Continued)

(58) Field of Classification Search
CPC ..... B22F 1/065; B22F 1/142; B22F 1/148; B22F 1/16; B22F 3/02; B22F 5/106;
(Continued)

(56) References Cited

U.S. PATENT DOCUMENTS 5,800,636 A * 9/1998 Tsukada ..... H01F 41/0246 148/306
2002/0189401 A1* 12/2002 Takaya ..... H01F 1/20 75/348

(Continued)

FOREIGN PATENT DOCUMENTS

JP 2014156635 A * 8/2014
JP 2015-233119 A 12/2015

(Continued)

OTHER PUBLICATIONS

Machine translation of KR 102068972 via EPO (Year: 2016).*
Machine translation of JP 2014-156635 via EPO (Year: 2014).*

*Primary Examiner* — Holly Rickman
*Assistant Examiner* — Rebecca L Grusby
(74) *Attorney, Agent, or Firm* — Oliff PLC

(57) ABSTRACT

A method for producing soft magnetic metal powder includes: a raw material powder preparing step of preparing metal raw material powder having metal raw material particles including iron, silicon, and boron; a mixture step of mixing the metal raw material powder and a carbon source substance and obtaining mixed powder; and a heat treatment step of performing heat treatment on the mixed powder in a non-oxidizing atmosphere containing nitrogen at a heat treatment temperature of 1,250° C. or higher and making the metal raw material particles spherical.

5 Claims, 10 Drawing Sheets

(51) Int. Cl.

| | |
|---|---|
| ***H01F 41/02*** | (2006.01) |
| ***H01F 3/08*** | (2006.01) |
| ***H01F 1/24*** | (2006.01) |
| ***C22C 38/00*** | (2006.01) |
| ***C22C 38/34*** | (2006.01) |
| ***C22C 33/02*** | (2006.01) |
| ***B22F 1/16*** | (2022.01) |
| ***B22F 1/065*** | (2022.01) |
| ***B22F 1/142*** | (2022.01) |
| ***B22F 1/148*** | (2022.01) |
| ***H01F 1/153*** | (2006.01) |

(52) U.S. Cl.
CPC ..... *B22F 1/148* (2022.01); *B22F 1/16* (2022.01); *C22C 33/02* (2013.01); *C22C 38/002* (2013.01); *C22C 38/02* (2013.01); *C22C 38/34* (2013.01); *H01F 1/24* (2013.01); *H01F 3/08* (2013.01); *H01F 41/0246* (2013.01); *H01F 1/147* (2013.01); *H01F 1/153* (2013.01)

(58) Field of Classification Search
CPC .... B22F 9/04; B22F 2201/02; B22F 2302/35; B22F 2302/40; B22F 2998/10; B22F 2999/00; C22C 33/02; C22C 33/0271; C22C 38/002; C22C 38/02; C22C 38/34; C22C 2202/02; H01F 1/147; H01F 1/14766; H01F 1/153; H01F 1/15308; H01F 1/24; H01F 3/08; H01F 41/0246; H01F 1/12; H01F 1/14; H01F 1/14733; H01F 1/1475; H01F 1/20
See application file for complete search history.

(56) References Cited

U.S. PATENT DOCUMENTS

| | | | |
|---|---|---|---|
| 2013/0255836 | A1 | 10/2013 | Otsuka et al. |
| 2015/0332821 | A1 | 11/2015 | Sakurai et al. |
| 2015/0332824 | A1 | 11/2015 | Sakurai et al. |
| 2016/0225503 | A1 | 8/2016 | Taniguchi et al. |

FOREIGN PATENT DOCUMENTS

| | | | |
|---|---|---|---|
| JP | 2016-139748 | A | 8/2016 |
| JP | 2016-216818 | A | 12/2016 |
| KR | 10-2013-0111357 | A | 10/2013 |
| KR | 10-2015-0130925 | A | 11/2015 |
| KR | 10-2016-0094860 | A | 8/2016 |
| KR | 10-2016-0134548 | A | 11/2016 |

* cited by examiner

SOFT MAGNETIC METAL POWDER, METHOD FOR PRODUCING THE SAME, AND SOFT MAGNETIC METAL DUST CORE

BACKGROUND OF THE INVENTION

The present invention relates to soft magnetic metal powder, a method for producing the same, and a soft magnetic metal dust core, particularly, to soft magnetic metal powder, a method for producing the same, and a soft magnetic metal dust core that are suitably used for a core of an electromagnetic circuit component such as an inductor or a reactor.

As a core material for a reactor or an inductor that is used for applying a high current, there is used a ferrite core, a dust core which is configured of soft magnetic metal powder, a stacked electrical steel sheet that uses a silicon steel sheet, or the like.

Of the core materials, the soft magnetic metal dust core has a smaller core loss than that of the stacked electrical steel sheet and a higher saturation magnetic flux density than that of the ferrite core, and thus the soft magnetic metal dust core is widely used as a core material.

The reactor and the inductor need to have both of a small size and good magnetic characteristics. In particular, as the magnetic characteristics, high inductance needs to be obtained even when DC currents are superimposed. Therefore, the soft magnetic metal dust core needs to have high permeability even when a superimposed DC magnetic field is applied, that is, to have good DC superimposition characteristics.

In order to improve the DC superimposition characteristics of the soft magnetic metal dust core, an increase in density of the core, an increase in roundness of soft magnetic metal powder to be used, or the like is known to be effective. For example, Patent Document 1 discloses that a dust core having good DC superimposition characteristics is obtained by using soft magnetic metal powder having high roundness and a small amount of fine powder.

In addition, since the reactor and the inductor need to have high efficiency, the soft magnetic metal dust core needs to have a low core loss.

In order to reduce the core loss of the soft magnetic metal dust core, both of a hysteresis loss and an eddy current loss that configure the core loss need to be reduced. In order to reduce the hysteresis loss, a decrease in coercivity of soft magnetic metal powder to be used is known to be effective. For example, Patent Document 2 discloses that soft magnetic metal powder is subjected to a heat treatment at a high temperature such that coercivity is reduced, and a soft magnetic metal dust core, in which a core loss is reduced, is obtained. On the other hand, in order to reduce the eddy current loss, a decrease in particle size of soft magnetic metal powder to be used is effective, particularly, a decrease in an amount of coarse powder is effective.

Hence, the soft magnetic metal powder that is used for the soft magnetic metal dust core needs to have low coercivity, high roundness, and a small amount of fine powder.

Patent Document 1: Japanese Patent Laid-Open 2016-139748

Patent Document 2: Japanese Patent Laid-Open 2015-233119

Patent Document 1 discloses that it is possible to obtain a dust core having good DC superimposition characteristics by using soft magnetic metal powder having high roundness and a small amount of fine powder. However, Patent Document 1 discloses, as a specific method of obtaining such soft magnetic metal powder, only a method of removing fine powder through classification from metal powder such as gas-atomized powder, which has high roundness.

Patent Document 2 discloses that soft magnetic metal powder is subjected to a heat treatment at a high temperature such that it is possible to reduce coercivity. However, a shape of particles and a particle size distribution are determined by characteristics of metal powder and cannot be improved by the heat treatment.

A water-atomization method, a gas-atomization method, or the like is known as a general production method for obtaining the metal powder.

According to the water-atomization method, it is possible to produce water-atomized powder at low cost. In addition, according to the water-atomization method, droplets of molten metal are rapidly quenched and solidified such that particles are obtained, and thus it is possible to obtain powder having a small average particle size. However, a shape of powder is irregular, and it is difficult to obtain particles having a spherical shape through the water-atomization method.

On the other hand, the gas-atomized powder that is produced through the gas-atomization method is obtained at higher cost than that of the water-atomized powder. However, according to the gas-atomization method, droplets of molten metal are relatively slowly cooled and solidified such that particles are obtained, and thus it is possible to obtain powder having a shape close to a true spherical shape. However, there is a problem in that only powder having a larger average particle size is obtained than that of the water-atomized powder that is produced through the water-atomization method.

Further, there is a problem in that, in both the water-atomization method and the gas-atomization method, the particle size distribution of powder to be produced is wide and a large amount of fine powder is contained. For example, as disclosed in Patent Document 1, the gas-atomized powder is classified, fine particles are removed while the average particle size of powder is reduced by removing coarse particles, and thereby it is possible to obtain metal powder having high roundness, a small average particle size, and a small amount of fine powder. However, since it is necessary to remove coarse particles and fine particles, costs for performing classification and a disposal loss of powder due to the classification increase, and thus the method is not practical.

Hence, there is a problem in that it is very difficult to obtain soft magnetic metal powder having small coercivity, high roundness, and small amount of fine powder.

SUMMARY OF THE INVENTION

The present invention was attained in view of such circumstances, and an object thereof is to provide soft magnetic metal powder having low coercivity, high roundness, and a small amount of fine powder, a method for producing the soft magnetic metal powder, and a soft magnetic metal dust core obtained by using the soft magnetic metal powder.

In order to attain the above object, a method for producing soft magnetic metal powder according to the present invention is

[1] a method for producing soft magnetic metal powder includes: a raw material powder preparing step of preparing a metal raw material powder having metal raw material particles including iron, silicon, and boron; a mixture step of mixing the metal raw material powder and a carbon source substance and obtaining mixed powder; and a heat treatment step of performing heat treatment on the mixed powder in a non-oxidizing atmosphere containing nitrogen at a heat treatment temperature of 1,250° C. or higher and making the metal raw material particles spherical.

[2] The method for producing soft magnetic metal powder according to [1] includes: a boron nitride removing step of removing a part of boron nitride contained in the soft magnetic metal powder obtained after the heat treatment step.

[3] In the method for producing soft magnetic metal powder according to [1] or [2], in the raw material powder preparing step, an amount of the boron contained in 100 mass % of the metal raw material powder is 0.4 mass % or more and 2.0 mass % or less.

[4] In the method for producing soft magnetic metal powder according to any one of [1] to [3], in the raw material powder preparing step, an amount of oxygen contained in 100 mass % of the metal raw material powder is 0.100 mass % or more and 1.000 mass % or less.

[5] In the method for producing soft magnetic metal powder according to any one of [1] to [4], in the heat treatment step, a coating portion containing boron nitride is formed on a surface of each of the metal raw material particles.

[6] Soft magnetic metal powder has metal particles including iron, silicon, boron, and carbon. An amount of boron contained in 100 mass % of the soft magnetic metal powder is 0.010 mass % or more and 2.0 mass % or less, and an amount of carbon contained in 100 mass % of the soft magnetic metal powder is 0.010 mass % or more and 0.350 mass % or less. Boron nitride is formed on a surface of the metal particles. Of the metal particles, roundness of 80% or more of metal particles is 0.80 or higher. Of the metal particles, 85% or more of metal particles have one crystal grain.

[7] In the soft magnetic metal powder according to [6], an amount of chromium contained in 100 mass % of the soft magnetic metal powder is 1 mass % or more and 10 mass % or less.

[8] In the soft magnetic metal powder according to [6] or [7], when a total amount of iron and nickel contained in the soft magnetic metal powder is 100 mass %, an amount of nickel is 40 mass % or more and 80 mass % or less.

[9] In the soft magnetic metal powder according to any one of [6] to [8], an amount of carbon contained in the metal particles is 0.010 mass % or more and 0.150 mass % or less.

[10] In the soft magnetic metal powder according to any one of [6] to [9], an amount of oxygen contained in 100 mass % of the soft magnetic metal powder is 0.1000 mass % or less.

[11] A soft magnetic metal dust core includes the soft magnetic metal powder according to any one of [6] to [10].

According to the present invention, it is possible to provide soft magnetic metal powder having small coercivity, high roundness, and a small amount of fine powder, a method for producing the soft magnetic metal powder, and a soft magnetic metal dust core obtained by using the soft magnetic metal powder.

DETAILED DESCRIPTION OF THE PREFERRED EMBODIMENTS

Figure 1:
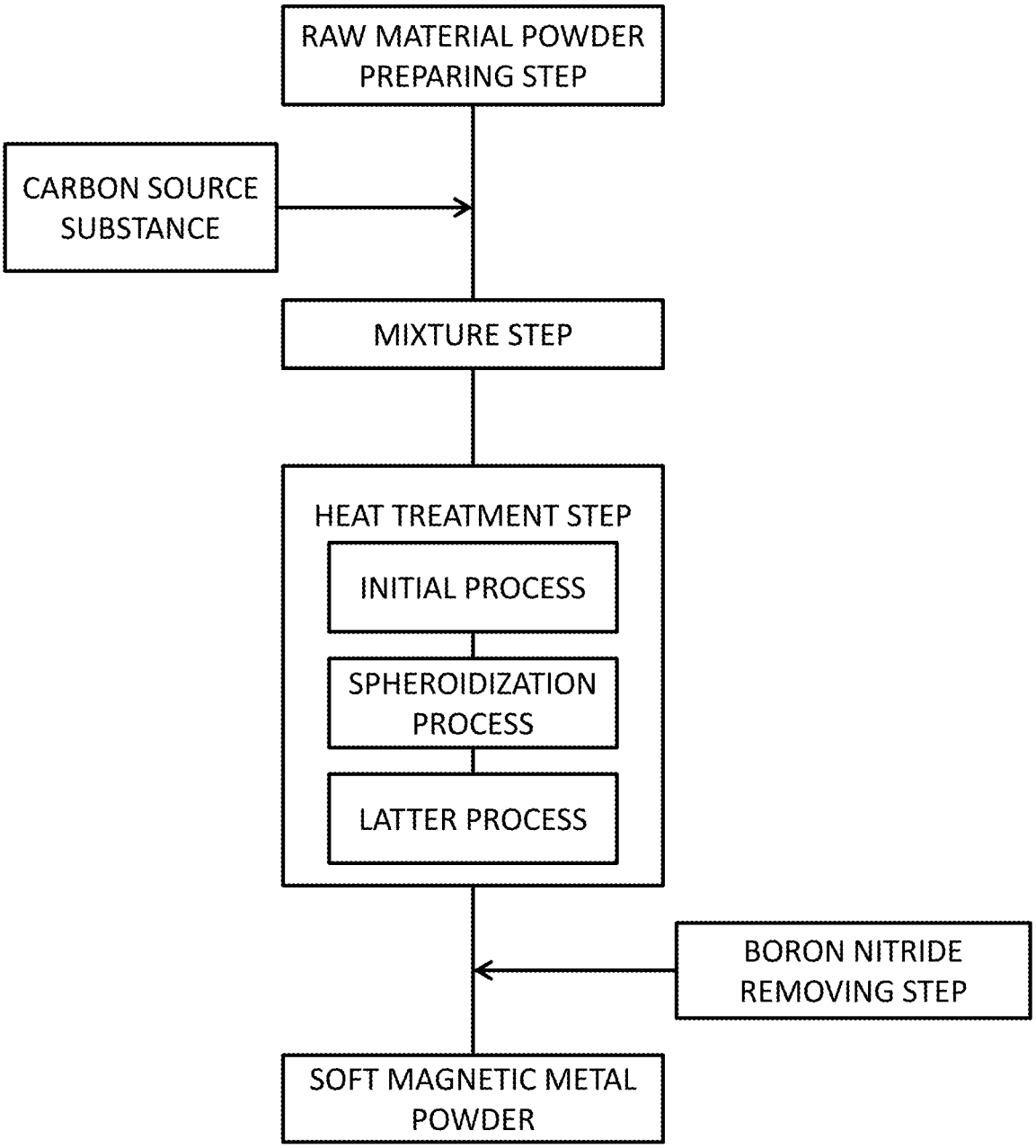
FIG. 1 is a step diagram illustrating a production method according to a present embodiment.

Hereinafter, the present invention will be described based on a present embodiment shown in the drawings in the following order.

1. Method for Producing Soft Magnetic Metal Powder
   - 1.1. Raw Material Powder Preparing Step
   - 1.2. Mixture Step
   - 1.3. Heat Treatment Step
     - 1.3.1. Initial Process
     - 1.3.2. Spheroidization Process
     - 1.3.3. Latter Process
   - 1.4. Boron Nitride Removing Step
2. Soft Magnetic Metal Powder
   - 2.1. Amount of boron
   - 2.2. Amount of carbon
   - 2.3. Amount of oxygen
   - 2.4. Amount of nitrogen
   - 2.5. Roundness of Particle
   - 2.6. Crystal Grain Size of Particle
   - 2.7. Particle Size Distribution
3. Soft Magnetic Metal Dust Core A method for producing soft magnetic metal powder according to the present embodiment is a method of performing, under a non-oxidizing atmosphere containing nitrogen, heat treatment on mixed powder obtained by mixing metal raw material powder configured of metal raw material particles including iron (Fe), silicon (Si), boron (B), and oxygen (O) and an additive made of a carbon source. Hereinafter, the method for producing soft magnetic metal powder will be described in detail with reference to a step diagram shown in FIG. 1.

1.1. Raw Material Powder Preparing Step

First, raw material powder is prepared. In the present embodiment, raw material powder is metal raw material powder having metal raw material particles including iron, silicon, and boron.

The metal raw material powder is Fe—Si alloy powder including iron and silicon, and thus oxygen is necessarily contained therein. In addition, chromium (Cr) may be further contained in the metal raw material powder. Nickel (Ni) may be further contained in the metal raw material powder.

In the present embodiment, silicon shows an effect of reducing magnetocrystalline anisotropy and magnetostriction constant of the soft magnetic metal powder. In addition, silicon plays a part of a role of making the metal raw material particles spherical in a heat treatment step described below.

An amount of silicon contained in 100 mass % of metal raw material powder is preferably 1.0 mass % or more and more preferably 3.0 mass % or more. In addition, the amount of silicon is preferably 10.0 mass % or less and more preferably 7.0 mass % or less. When the amount of silicon is too small, spheroidization of metal raw material particles tends to be insufficient. On the other hand, when the amount of silicon is too large, hardness of metal particles, which is obtained by making the metal raw material particles spherical, too much increases, and thus density of soft magnetic metal dust core tends to decrease.

Boron contained in soft magnetic metal tends to increase coercivity of powder, and thus, in general, it is not preferable to contain boron. However, in the present embodiment, as will be described below, boron contained in the metal raw material particles in the heat treatment step is used for spheroidization of the particles and is discharged as boron nitride to an outer side of the metal raw material particles. Hence, an amount of boron in the metal particles constituting soft magnetic metal powder, which will be finally obtained, is smaller than an amount of boron in metal raw material particles constituting the metal raw material powder. Hence, even when a predetermined amount of boron is contained in the metal raw material powder and the coercivity of the metal raw material powder is high, it is possible to reduce coercivity of the soft magnetic metal powder, which will be finally obtained.

The amount of boron contained in 100 mass % of metal raw material powder is preferably 0.4 mass % or more and more preferably 0.8 mass % or more. In addition, the amount of boron is preferably 2.0 mass % or less, more preferably 1.6 mass % or less, and further more preferably 1.2 mass % or less. When the amount of boron is too small, boron used for making metal material particles spherical tends to be insufficient. On the other hand, when the amount of boron is too large, time taken to complete spheroidization tends to be lengthened.

Chromium has an effect of enhancing an antirust effect and electrical resistance of the soft magnetic metal powder. An amount of chromium contained in 100 mass % of metal raw material powder is preferably in a range of 1 mass % to 10 mass %.

Nickel has an effect of decreasing the magnetocrystalline anisotropy and the magnetostriction constant of the soft magnetic metal powder. In the present embodiment, when an amount of nickel and iron contained in the metal raw material powder is 100 mass %, an amount of nickel (a mass ratio of Ni/(Fe+Ni)) is in a range of 40 mass % to 80 mass %.

When oxygen is contained in soft magnetic metal, oxygen increases coercivity, and thus oxygen is recognized as an impurity, in general. Hence, an amount of oxygen needs to be small. However, in the present embodiment, as will be described below, when oxygen contained in metal raw material particles is used for making the particles spherical in the heat treatment step, oxygen is separated from the particles and converted into gas, and thus an amount of oxygen contained in metal particles constituting soft magnetic metal powder, which will be finally obtained, can be more decreased than an amount of oxygen contained in the metal raw material particles constituting the metal raw material powder. Hence, even when a predetermined amount of oxygen is contained in the metal raw material powder and the coercivity of the metal raw material powder is high, it is possible to reduce coercivity of the soft magnetic metal powder, which will be finally obtained.

The amount of oxygen contained in 100 mass % of metal raw material powder is preferably 0.100 mass % or more and more preferably 0.200 mass % or more. In addition, the amount of oxygen is preferably 1.000 mass % or less and more preferably 0.600 mass % or less.

An average particle size of the metal raw material powder is not particularly limited; however, the average particle size needs to be smaller than a target average particle size of the soft magnetic metal powder produced through the method according to the present embodiment. As will be described below, in the present embodiment, this is because spheroidization is achieved in response to binding of the metal raw material particles constituting the metal raw material powder to each other. Hence, a shape of the metal raw material particles constituting the metal raw material powder is not particularly limited and may be irregular.

A method of producing the metal raw material powder is not particularly limited and, in the present embodiment, a water-atomization method, a gas-atomization method, a pulverization of cast metal, or the like are exemplified. Here, the water-atomization method, in which fine powder tends to be obtained, is preferably used.

Figure 2:
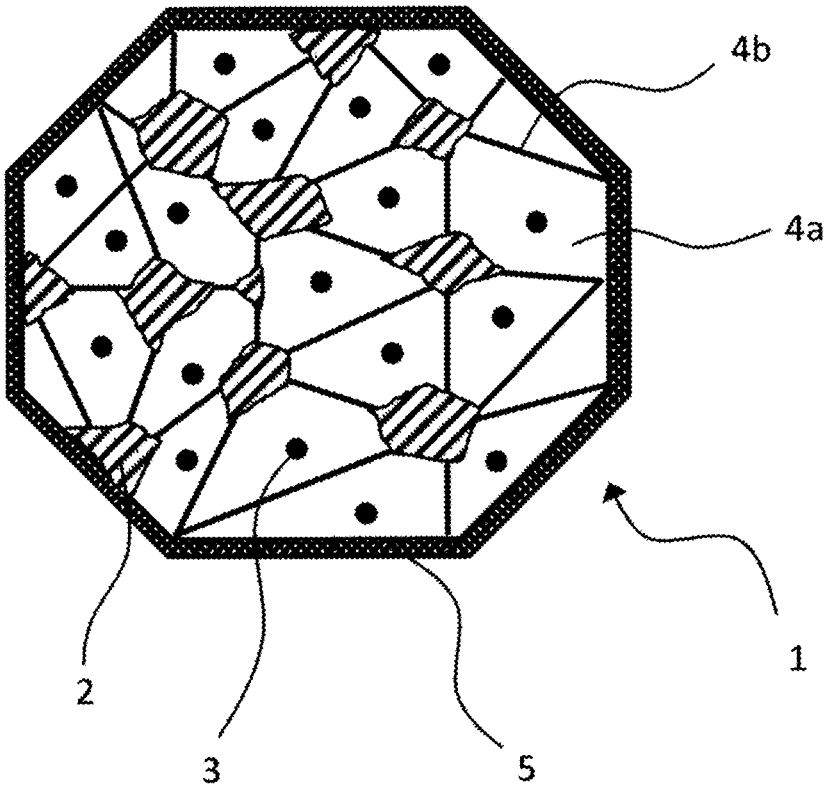
FIG. 2 is a schematic diagram of a cross section of a particle constituting a metal raw material powder.

FIG. 2 shows a schematic diagram of a cross section of a metal raw material particle constituting the metal raw material powder. A cross-sectional shape of a metal raw material particle 1 constituting the metal raw material powder is irregular. A crystal grain 4*a* made of a Fe—Si based alloy and a $Fe_2B$ phase 2 which is an alloy of iron and boron are present inside the particle 1, and a crystal grain boundary 4*b* is present between the crystal grains 4*a* and between the crystal grain 4 and the $Fe_2B$ phase 2. In addition, in the crystal grain 4*a*, boron 3 contained in a Fe—Si alloy is present. A surface of the particle 1 is covered with oxide 5.

1.2. Mixture Step

In a mixture step, the metal raw material powder and a carbon source substance are mixed, and thereby mixed powder is produced. The carbon source substance is not particularly limited as long as the carbon source substance is a substance that is able to supply carbon in the heat treatment step described below. In the present embodiment, the carbon source substance is carbon and/or an organic compound.

Carbon is exemplified by carbon powder of graphite, carbon black, amorphous carbon, or the like. The organic compound is exemplified by a substance that is thermally decomposed when heated in a non-oxidizing atmosphere such that carbon is generated. Specifically, hydrocarbon, alcohol, resin, or the like is exemplified.

In the heat treatment step described below, the carbon source substance causes a fine particle containing carbon to be attached to a surface of the metal raw material particle constituting the metal raw material powder. The attached fine particle containing carbon can play a part of a role of making the particles spherical. When the carbon source substance is the organic compound, the organic compound is heated in the non-oxidizing atmosphere so as to be thermally decomposed, and fine particles containing carbon are generated and are attached to the surface of the particle.

The carbon source substance may be configured of only carbon, may be configured of only the organic compound, or may be configured of carbon and the organic compound. In addition, carbon and the organic compound may include two or more types of exemplified substances, respectively.

In the present embodiment, the carbon source substance is preferably carbon powder. This is because carbon is attached to the surface of the particle without being thermally decomposed, and thus it is easy to control an amount of carbon that contributes to a spheroidization reaction.

When a form of the carbon source substance is a powder form, it is preferable to use metal raw material powder obtained by being coated with the carbon source substance. Coating increases dispersibility of raw material powder and the carbon source substance such that it is possible to increase an effect of the spheroidization in the heat treatment step. A method of coating is not particularly limited as long as the method is a known method and, for example, there is provided a method of coating by mixing the metal raw material powder and a solvent obtained by dispersing powder of the carbon source substance in an organic solvent and drying a mixture thereof. In addition, an organic compound such as a resin may be used as a coating aid.

An amount of carbon source substance contained in the mixed powder is preferably 30 mass % or more and more preferably 90 mass % or more in terms of an amount of 100 mass % of oxygen contained in the metal raw material powder. The carbon source substance contained within a range described above promotes the spheroidization of the metal raw material particles in the heat treatment described below.

Figure 3:
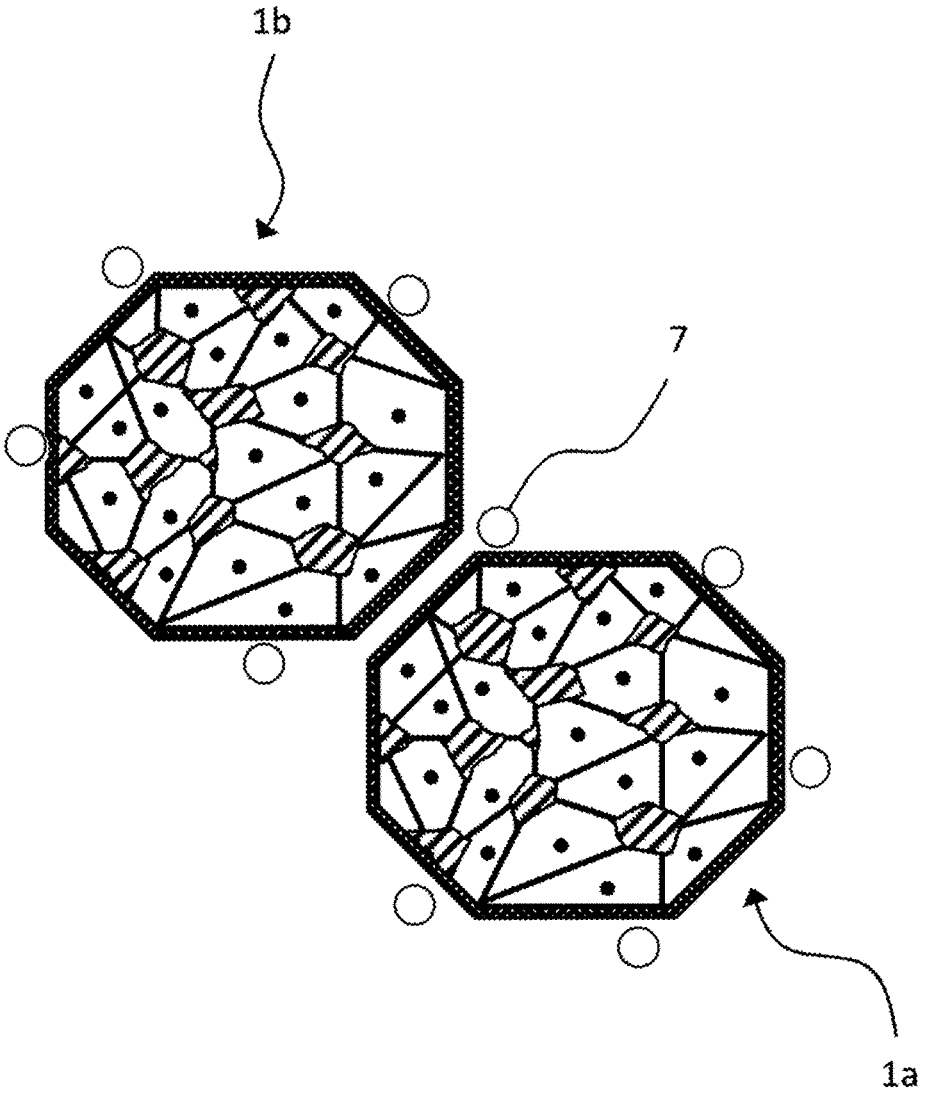
FIG. 3 is a schematic diagram of a cross section of a particle constituting a mixed powder.

FIG. 3 shows a schematic diagram of a cross section of a metal raw material particle constituting the mixed powder. Carbon source substances 7 are present around metal raw material particles 1*a* and 1*b* constituting the mixed powder.

1.3. Heat Treatment Step

In the heat treatment step, the prepared mixed powder is subjected to the heat treatment in flow current of a non-oxidizing atmosphere containing nitrogen. In the present embodiment, the heat treatment step can be divided into three processes of an initial process, a spheroidization process, and a latter process.

1.3.1. Initial Process

In the initial process, a temperature of the mixed powder is raised in the non-oxidizing atmosphere containing nitrogen. As the temperature is increased, nitrogen in the atmosphere reacts with a part of boron contained in the metal raw material particles of the metal raw material powder constituting the mixed powder such that a coating portion containing boron nitride is formed on a surface of each of the metal raw material particles. A boron source of boron nitride to be formed is both of boron contained in the crystal grain 4*a* made of the Fe—Si based alloy in the metal raw material particles and boron contained in the $Fe_2B$ phase 2 which is an alloy of iron and boron.

Figure 4:
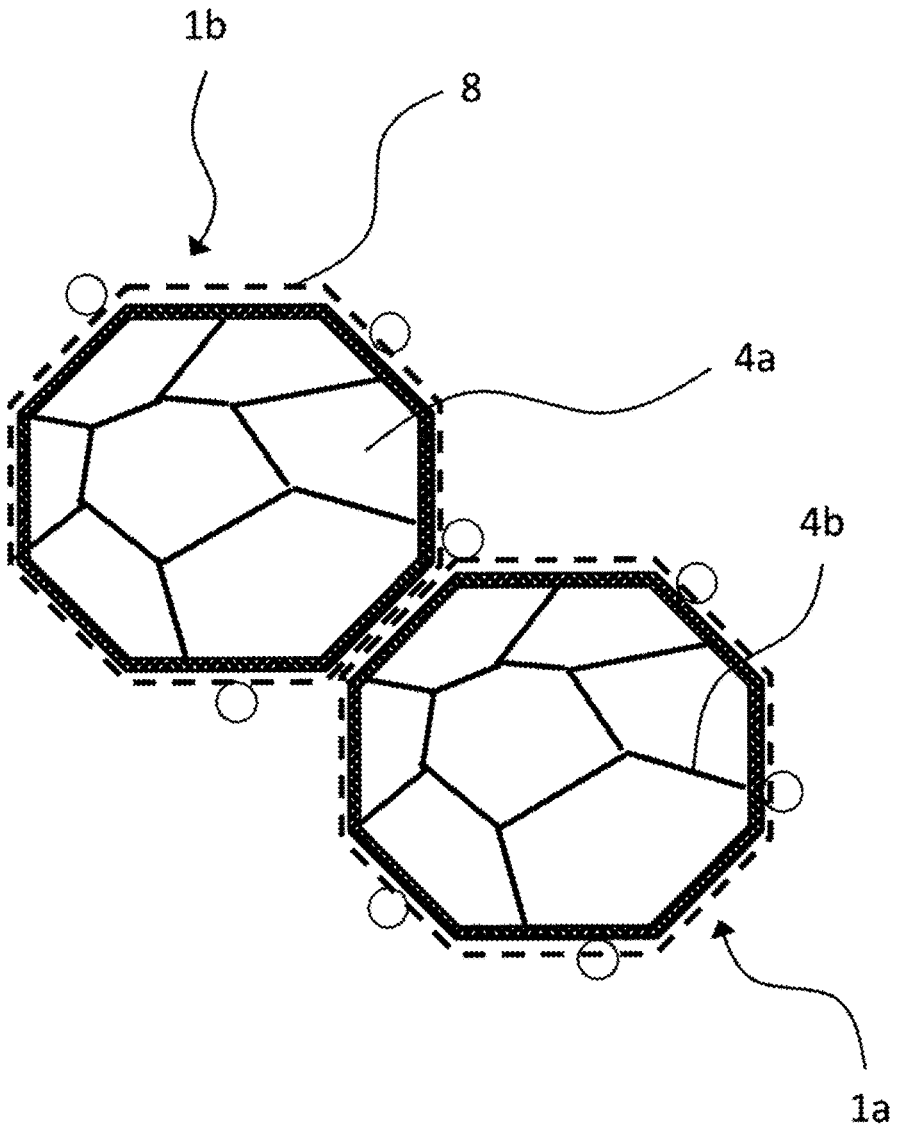
FIG. 4 is a schematic diagram for illustrating that boron nitride is formed on a surface of particles in an initial process of a heat treatment step.

Most of boron contained in the $Fe_2B$ phase is consumed for forming boron nitride. As a result, as shown in FIG. 4, the $Fe_2B$ phase is decomposed and substantially disappears. On the other hand, the crystal grain 4*a* made of the Fe—Si based alloy grows with releasing boron contained in the crystal grain 4*a* and incorporating iron constituting the $Fe_2B$ phase. As a result, the number of crystal grains included in the particles 1*a* and 1*b* is decreased; however, the particles 1*a* and 1*b* still contains crystal grains 4*a*. In addition, a cross-sectional shape of the particles 1*a* and 1*b* is irregular in the initial process and is substantially similar to a cross-sectional shape of a metal raw material particle of the raw material powder before the heat treatment step shown in FIG. 3.

Note that a total amount of boron contained in the crystal grains 4*a* and boron contained in the $Fe_2B$ phase may not be completely used for forming boron nitride and boron may remain in the particles. The remaining boron is mainly present inside the crystal grain 4*a* or on a crystal grain boundary 4*b*.

In addition, as shown in FIG. 4, in the present embodiment, the coating portion is a flake 8 of boron nitride. The flake 8 may cover at least a part of surfaces of the particles 1*a* and 1*b*; however, as shown in FIG. 4, it is preferable to cover the entire surfaces.

The amount of boron in each of the metal raw material particles constituting the metal raw material powder is substantially constant, and a particle has a large specific surface area as the particle has a small particle size. Hence, a particle having a small particle size has a small thickness of the flake of boron nitride which is formed in the initial process.

The carbon source substance is present between the metal raw material particles 1*a* and 1*b* as a fine particle of carbon; however, a part of carbon is diffused into the inside of the metal raw material particles 1*a* and 1*b* and promote the spheroidization of the metal raw material particles. Note that, when the carbon source substance is the organic compound, the organic compound is thermally decomposed such that fine particles of carbon are generated on surfaces of the metal raw material particles 1*a* and 1*b* constituting the metal raw material powder in the initial process. A part of the generated carbon is diffused into the inside of the metal raw material particle.

1.3.2. Spheroidization Process

In the spheroidization process, oxygen contained in the particles constituting the metal raw material powder is reduced by carbon, and a gas of carbon monoxide (CO) is generated. As shown in FIGS. 2 to 4, oxygen contained in the metal raw material powder is bound to a metallic element such as silicon so as to form an oxide, and the oxide is present on the surface of the metal raw material particle. The oxide present on the particle surface is reduced to metal by carbon contained in the above-described mixed powder and carbon generated in the initial process. The oxygen generated by reduction reacts with the carbon and generates a gas of carbon monoxide, and thus the amount of oxygen contained in the metal raw material particle is reduced.

In addition, when the carbon monoxide gas is generated, partial pressure of the carbon monoxide in the vicinity of the particle surface increases, and thus partial pressure of nitrogen around the surface decreases relatively. Boron nitride can be stable in a case where partial pressure of nitrogen is high; however, when the partial pressure of nitrogen decreases, boron nitride becomes unstable and tends to be decomposed into boron and nitrogen.

Hence, in the spheroidization process, as carbon monoxide is generated, a part of boron nitride formed on the metal raw material particle surface in the initial process is decomposed. The generated boron is incorporated in the metal raw material particle and reacts with a metallic component such as iron, and an alloy containing boron is generated. Since a melting point of the alloy is low, the alloy is present as a liquid phase 9 of the alloy containing boron on an outer layer of the metal raw material particle. Note that, in the initial process, carbon diffused into the inside of the metal raw material particle is capable of lowering the melting point of the liquid phase 9 and further promoting the spheroidization.

Figure 5:
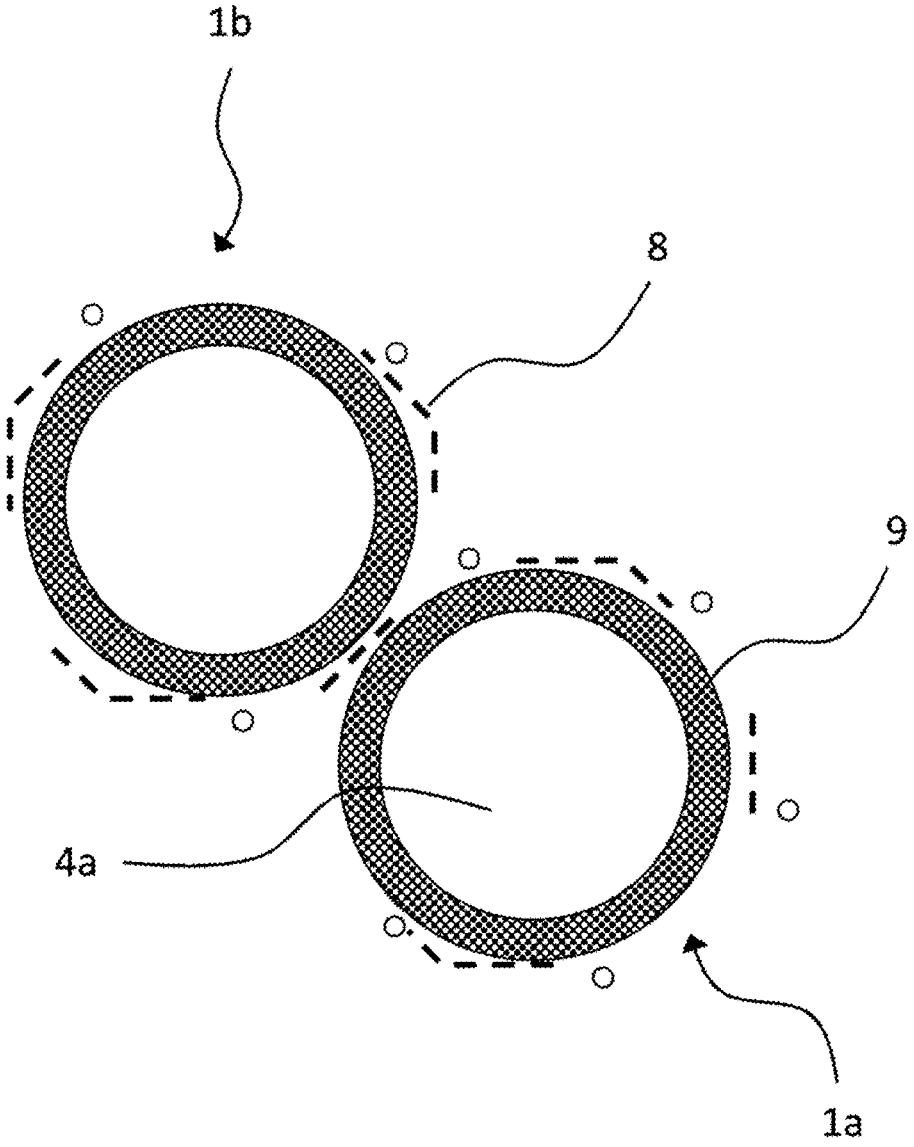
FIG. 5 is a schematic diagram for illustrating that the particle is formed into a spherical shape in a spheroidization process of the heat treatment step.

The liquid phase 9 has very poor wettability with boron nitride. Hence, the liquid phase 9 wraps around the crystal grain 4*a* presented on an inner side of the liquid phase 9 without attaching to boron nitride 8 on an interface between the boron nitride 8 remaining on the particle surface and the liquid phase 9 when the liquid phase 9 reduces a surface area due to surface tension. As a result, even when the shape of the metal raw material particle is irregular before the spheroidization process, the metal raw material particle becomes spherical so that the metal particle with a spherical shape is obtained, as shown in FIG. 5.

As described above, as the particle size of the metal raw material particle decreases, a thickness of boron nitride which is formed on the surface decreases. Hence, for the metal raw material particle having a small particle size, there is a low probability that undecomposed boron nitride is present around the liquid phase 9 that is generated due to decomposition of boron nitride, and thus the liquid phase 9 is easily exposed to the outer side of the particle. As a result, a metal particle having the small particle size highly often comes into contact with another metal particle having a small particle size present therearound via the liquid phase 9.

Figure 6A:
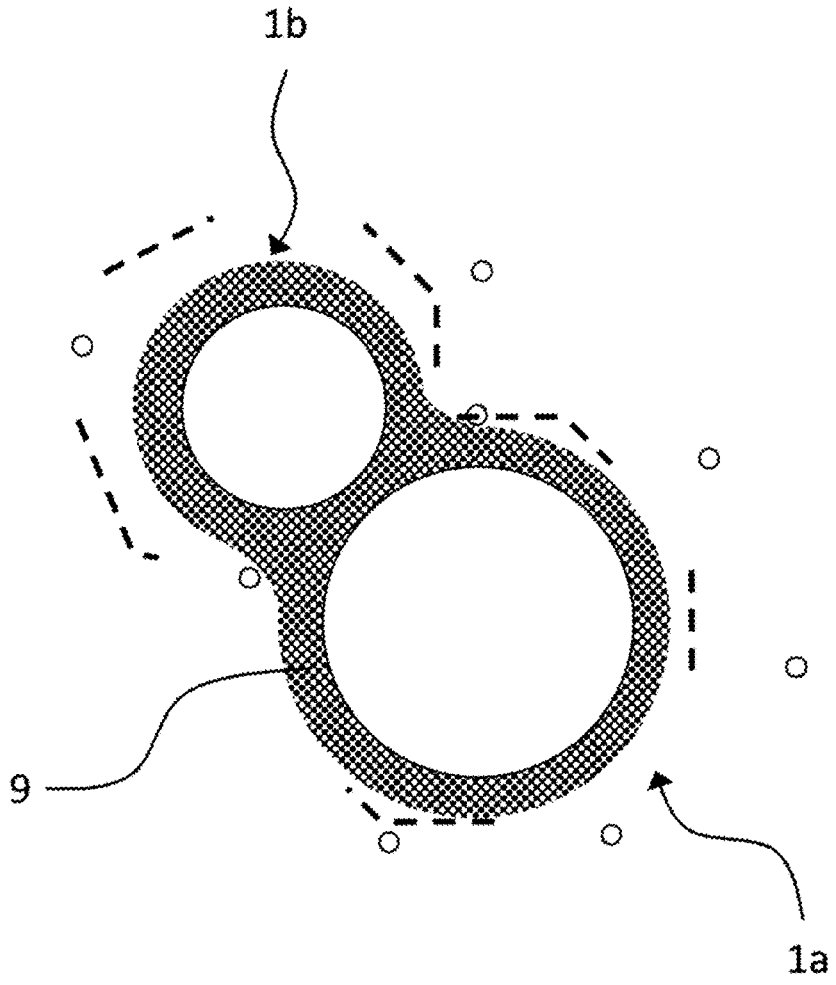
FIG. 6A is a schematic diagram for illustrating that the particles are bound to each other in the spheroidization process of the heat treatment step.
Figure 6B:
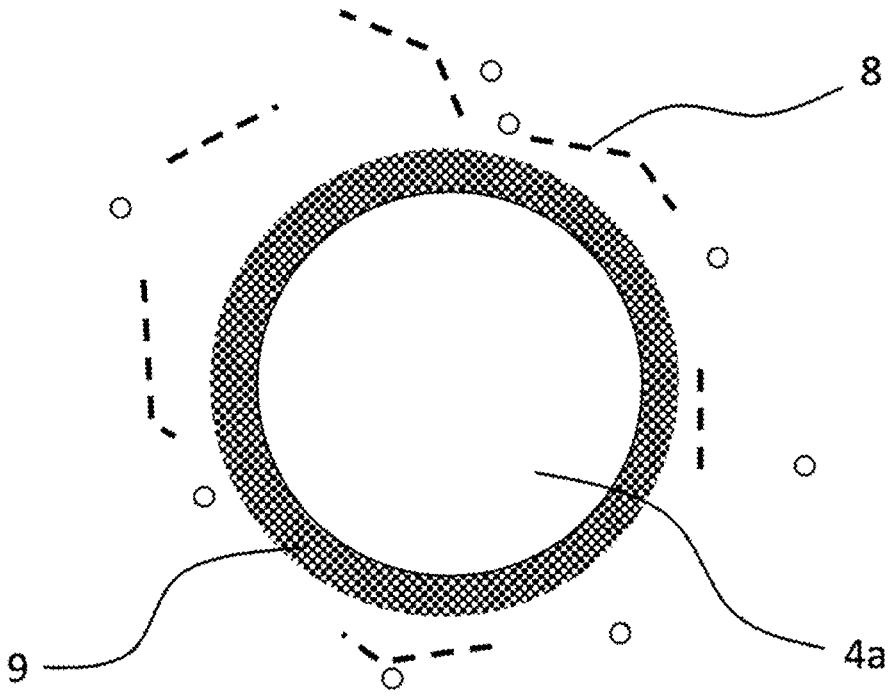
FIG. 6B is a schematic diagram for illustrating that the particles are integrated with each other such that one spherical particle is generated in the spheroidization process of the heat treatment step.

As shown in FIGS. 6A and 6B, the liquid phase of the two spherical metal particles which are in contact with each other seeks to reduce a surface area thereof due to the surface tension, that is, the liquid phase seeks to become a spherical shape. Therefore, the two metal particles are integrated, and one spherical metal particle is formed. In the spherical metal particle, the metal crystal grain 4*a* which does not react with boron is present on the inner side of the liquid phase of the alloy containing boron; however, in order to lower interfacial free energy between the liquid phase 9 and the crystal grain 4*a*, the crystal grain 4*a* becomes spherical, and single crystallization also proceeds, in which crystal grains are integrated in one crystal grain. Hence, in the spheroidization process, a spherical metal particle, of which the outer layer is configured of the liquid phase of the alloy containing boron and an inner side is configured of one crystal grain, is generated.

Note that, when two metal particles are integrated, at least a part of boron nitride attached to the surfaces of the metal particles peels such that a flake of boron nitride detached from the metal particles is generated.

As described above, in the spheroidization process, since the metal particle having a small particle size is preferentially bound to another metal particle, the metal particle having the small particle size highly often becomes a metal particle having a particle size larger than the particle size before the spheroidization process. On the other hand, a thickness of boron nitride that is formed on a surface of the metal particle having a large particle size is relatively larger than a thickness of boron nitride that is formed on the surface of the metal particle having the small particle size. Although the spheroidization proceeds inside the metal particle having the large particle size, the liquid phases less often come into contact with each other than on the metal particle having the small particle size, and thus the metal particle having the large particle size is less often bound to and integrated in another metal particle. Therefore, a particle having the large particle size less often has a particle size larger than the particle size before the spheroidization process.

Hence, when a particle size distribution of the metal raw material particles contained in the metal raw material powder is compared with a particle size distribution of the metal particles contained in soft magnetic metal powder to be obtained, particles having the small particle size decrease and particles having the large particle size little increase in the particle size distribution of the metal particles contained in the soft magnetic metal powder. Hence, it is possible to obtain soft magnetic metal powder having small dispersion of the particle sizes of the metal particles.

Usually, it is known to be very difficult to reduce silicon oxide with carbon. For example, even when silicon oxide and carbon are mixed so as to be heated in the non-oxidizing atmosphere, a reduction reaction does not occur.

However, as described above, the present inventors have found that the silicon oxide present on a surface of an iron alloy containing silicon can be reduced by carbon by heating in the non-oxidizing atmosphere. Further, the present inventors have found that spheroidization of the particle proceeds only after a temperature at which the reduction reaction proceeds and a temperature at which the liquid phase is generated by boron and another component are substantially equal to each other.

1.3.3. Latter Process

When the reduction reaction of the above-described oxide proceeds, and oxygen and carbon are consumed for generating carbon monoxide, an amount of one or both of the oxygen and the carbon decreases. As a result, generation of carbon monoxide is ceased, thereby, the spheroidization process is also ceased, and the process proceeds to a latter process.

Figure 7:
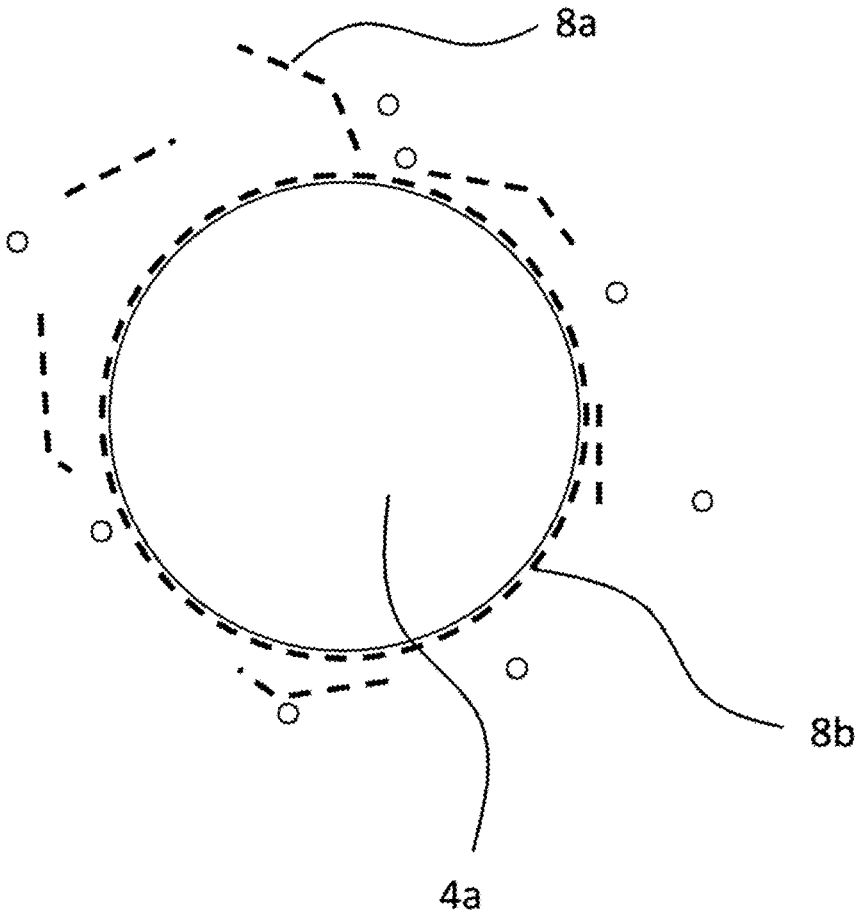
FIG. 7 is a schematic diagram of a cross section of a particle constituting soft magnetic metal powder obtained after the heat treatment step.

In the latter process, when the generation of carbon monoxide is ceased, the partial pressure of nitrogen therearound increases again, and thus boron contained in the liquid phase positioned on the outer layer of the metal particle reacts with nitrogen in an atmosphere such that boron nitride is formed on the surface of the metal particle again, as shown in FIG. 7. When an amount of boron in the liquid phase is decreased with the formation of boron nitride, an amount of the liquid phase of the alloy containing boron decreases, and a component dissolved in the liquid phase crystallizes on a surface of a crystal grain present on the inner side.

When boron in the liquid phase is consumed in a nitriding reaction and almost disappears, a reaction of forming boron nitride ceases, and it is possible to obtain a metal particle having boron nitride 8*b* formed on the surface of the spherical particle (crystal grain 4*a*) made of a single crystal, as shown in FIG. 7. After the latter process, most of boron in the metal grain is discharged as a flake 8*a* of boron nitride out of the metal particle; however, a minute amount of boron remains inside the metal particle.

Further, cooling is performed in the non-oxidizing atmosphere containing nitrogen, and thereby there is obtained soft magnetic metal powder having a small amount of oxygen, which is configured of metal particles having boron nitride formed on the spherical particle made of the single crystal.

It is preferable that the initial process, the spheroidization process, and the latter process described above be continuously performed in one heat treatment step; however, it is possible to divide the heat treatment step into several times and to perform each of the processes independently. In addition, in the present embodiment, in the heat treatment step, in order for the above-described reaction to proceed uniformly and smoothly, it is preferable that the mixed powder is filled in a container with a lib and the heat treatment be performed. In addition, it is preferable to control a flow rate of an atmosphere gas (nitrogen gas or the like).

In the heat treatment step, the partial pressure of nitrogen in the atmosphere is preferably 0.5 atm or higher, more preferably 0.9 atm or higher, and particularly preferably 1.0 atm or higher. In a case where pressure of the atmosphere is atmospheric pressure, a nitrogen concentration is preferably 50% or higher, more preferably 90% or higher, and particularly preferably 100%, that is, pure nitrogen. In addition, partial pressure of oxygen in the atmosphere is preferably 0.0001 atm or lower. When the partial pressure of oxygen is too high, an oxidation reaction of metal proceeds in parallel with the nitriding reaction, and thus the coating portion tends to be formed ununiformly.

In the heat treatment step, a heat treatment temperature is 1,250° C. or higher and preferably 1,300° C. or higher. In addition, the heat treatment temperature is 1,500° C. or lower. When the heat treatment temperature is too low, a series of reactions in association with the spheroidization tend not to proceed. On the other hand, when the heat treatment temperature is too high, a decomposition reaction of boron nitride proceeds too much, or a generation amount of an alloy of the liquid phase increases too much, and thus it is likely to be difficult to control.

Note that, the metal raw material particles of the metal raw material powder are likely to adhere to each other and are easily sintered at a high temperature of 1,000° C. or higher. However, in the present embodiment, the coating portion containing boron nitride is rapidly formed on the surface of the metal raw material particles in the initial process, and a particle of carbon derived from the mixed powder is also interposed between the particles. As a result, adhesion of the metal raw material particles to each other is suppressed and the particles are hard to sinter. This is because boron nitride and carbon have high heat resistance and sintering resistance and inhibit the particles from being sintered with each other.

1.4. Boron Nitride Removing Step

As is clear from FIG. 7, since boron nitride is formed on the surface of the metal particle after the heat treatment step, the flake of boron nitride is contained in the soft magnetic metal powder after the heat treatment step. In a case where a dust core is molded by using the soft magnetic metal powder, the flake of boron nitride is present between soft magnetic metal particles. Boron nitride has lower density than that of the metal particles, and thus relative density of the dust core tends to slightly decrease. In addition, since boron nitride has non-magnetic, boron nitride present between the soft magnetic metal particles generates a demagnetizing field in the soft magnetic metal particle. As a result, permeability of the dust core decreases. Therefore, in a case where the permeability of the dust core needs to be high, it is preferable to perform a boron nitride removing step to the soft magnetic metal powder after the spheroidization process.

Such flake of such boron nitride can be separated from the soft magnetic metal particles through a predetermined operation. In a case where high permeability does not need, it is possible to mainly separate the flake that easily peels by using a classifying device of sieving separation, cyclone separation, electrostatic separation, magnetic classification, wind force classification, wet sedimentation separation, or the like.

In addition, in a case where it is necessary to have high permeability, for example, by grinding the soft magnetic metal powder, it is possible to apply a small impact force to the soft magnetic metal particles so as to forcibly separate the flake of boron nitride from the soft magnetic metal particles. For grinding, it is possible to use a general grinding device such as a wet ball mill, a dry ball mill, or a jet mill. In addition, a multifunction device such as grinding device having a classification function may be used.

In the present embodiment, it is preferable that the flake of boron nitride is forcibly separated from the soft magnetic metal particles using a combination of grinding and separation. For example, grinding may be performed by the wet ball mill, after that, the soft magnetic metal particles and the flake of boron nitride may be forcibly separated from each other through magnetic separation. In addition, grinding may be performed through dry grinding, after that, the soft magnetic metal particles and the flake of boron nitride may be forcibly separated from each other through wet magnetic separation. Further, grinding may be performed through the dry grinding, after that, the soft magnetic metal particles and the flake of boron nitride may be forcibly separated from each other through wind force classification.

Note that, a removing rate of boron nitride changes in accordance with conditions of a grinding step or conditions of a separation step; however, even when the boron nitride removing step is performed, it is not possible to completely remove the flakes of boron nitride. Hence, at least a minute amount of boron nitride is contained in the soft magnetic metal powder after the boron nitride removing step. Therefore, in accordance with predetermined magnetic characteristics, boron nitride may be removed by controlling the classification, the grinding, or the like.

In addition, it is possible to remove carbon powder contained in the soft magnetic metal powder by performing the above-described boron nitride removing step. Note that, even when the boron nitride removing step is performed, it is not possible to completely remove the carbon powder. Hence, at least a minute amount of carbon is contained in the soft magnetic metal powder after the boron nitride removing step.

2. Soft Magnetic Metal Powder

It is possible to obtain the soft magnetic metal powder according to the present embodiment through the above-described steps. The soft magnetic metal powder according to the present embodiment has the following characteristics.

2.1. Amount of Boron

Forms of boron is contained in the soft magnetic metal powder according to the present embodiment are boron contained in the metal particle and boron nitride present outside the metal particle. As described above, most of boron becomes boron nitride in the latter process of the heat treatment step; however, a minute amount of boron remains also in the metal particle. Hence, an amount of boron in the metal particle of the soft magnetic metal powder is much smaller than an amount of boron in the metal raw material particle of the metal raw material powder; however, the same amount of boron as the amount of boron contained in the metal raw material powder is contained in the soft magnetic metal powder after the heat treatment step. In addition, as described above, a part of boron nitride may be removed in the boron nitride removing step. An amount of boron smaller than the amount of boron contained in the metal raw material powder is contained in the soft magnetic metal powder after the boron nitride removing step.

As described above, in order to make smooth progress of reaction in the heat treatment step, an amount of boron in 100 mass % of metal raw material powder is preferably 0.4 mass % or more and 2.0 mass % or less. Hence, 0.4 mass % or more and 2.0 mass % or less of boron is contained in 100 mass % of the soft magnetic metal powder after the heat treatment step.

In a case where the dust core is formed by using the soft magnetic metal powder, a part of boron nitride may be removed by performing the boron nitride removing step in order to adjust the permeability. However, it is very difficult to completely remove boron nitride, and thus boron nitride remains on the surface of the metal particle. In addition, a minute amount of boron is also contained in the metal particle, and thus 0.010 mass % or more of boron is contained in 100 mass % of the soft magnetic metal powder after the boron nitride removing step.

Note that, as the amount of boron in the soft magnetic metal, particularly, in crystalline soft magnetic metal increases, the coercivity of the soft magnetic metal increases, and thus it is preferable that the amount of boron in the metal particle of the soft magnetic metal be small. In the present embodiment, although a predetermined amount of boron is contained in the metal raw material particle of the metal raw material powder on purpose, boron contained in the particle is discharged as boron nitride out of the metal particle in the heat treatment step, and thus it is possible to reduce boron contained in the metal particle after the heat treatment. Hence, it is preferable that boron be discharged as boron nitride out of the metal particle as much as possible in the heat treatment step.

However, as boron contained in the metal particle decreases due to the nitriding reaction, it is difficult for the nitriding reaction to proceed thermodynamically. Hence, it is very difficult to completely discharge boron remaining in the particle. In particular, a certain amount of boron is known to be dissolved in a metal phase (for example, about 15 ppm at 900° C. with respect to Fe), and it is difficult to decrease the amount of boron in the metal particle, which is configured of a soft magnetic metal phase with Fe as a main component, to 15 ppm or less. On the other hand, the present inventors found that, when the amount of boron in the metal particle is 150 ppm or less, an influence on the coercivity is limited. The amount of boron in the metal particle is more preferably 100 ppm or less.

The amount of boron of the soft magnetic metal powder can be measured by an ICP. Boron of the soft magnetic metal powder is present as boron contained in the metal particle and boron contained in boron nitride. When the amount of boron contained in the metal particle of the soft magnetic metal powder is measured, it is necessary to remove an influence of detected boron derived from boron nitride. Since most of nitrogen contained in the soft magnetic metal powder is present as boron nitride, it is possible to quantitate an amount of boron nitride so as to calculate an amount of boron in the particle.

2.2. Amount of Carbon

Forms of carbon contained in the soft magnetic metal powder according to the present embodiment are carbon contained in the metal particle and carbon present outside the metal particle.

As the amount of carbon in the soft magnetic metal increases, the coercivity of the soft magnetic metal increases, and thus it is preferable that the amount of carbon in the metal particle be small. In the present embodiment, although the carbon source substance is added to the raw material powder on purpose, and carbon is attached to the surface of the metal raw material particle in the heat treatment step, carbon is discharged as carbon monoxide out of the soft magnetic metal powder in the spheroidization process. In the present embodiment, the amount of carbon in 100 mass % of the soft magnetic metal powder after the heat treatment step is 0.010 mass % or more and 0.350 mass % or less.

In addition, a part of carbon derived from the carbon source substance is diffused inside the metal raw material particle in the heat treatment step. The amount of carbon in the metal particle constituting the soft magnetic metal powder after the heat treatment is 0.010 mass % or more and 0.150 mass % or less.

2.3. Amount of Oxygen

As an amount of oxygen in the soft magnetic metal increases, the coercivity of the soft magnetic metal increases, and thus it is preferable that the amount of oxygen in the metal particle be small. In the present embodiment, although a predetermined amount of oxygen is contained in the metal raw material particle of the metal raw material powder on purpose, oxygen is discharged out of the metal particle by reducing the oxide formed on the surface of the metal raw material particle in the heat treatment step, and the discharged oxygen reacts with carbon such that carbon monoxide is formed. Hence, oxygen separated from the metal raw material particle by reducing the oxide is not present in the soft magnetic metal powder after the heat treatment step.

Hence, the amount of oxygen in the metal particle of the soft magnetic metal powder after the heat treatment step, that is, the amount of oxygen of the soft magnetic metal powder after the heat treatment step, can be smaller than an amount of oxygen in the metal raw material particle of the metal raw material powder, that is, an amount of oxygen of the soft magnetic metal powder before the heat treatment step. Specifically, the amount of oxygen in 100 mass % of the soft magnetic metal powder after the heat treatment step is preferably 0.1000 mass % or less. When the conditions of the heat treatment step are adjusted, the amount of oxygen in the soft magnetic metal powder can be 0.0500 mass % or less. In addition, when handling the soft magnetic metal powder in the air, oxidation of the surface thereof is unavoidable, and thus several ppm or more of oxygen is contained in the soft magnetic metal powder.

2.4. Amount of Nitrogen

Nitrogen contained in the soft magnetic metal powder according to the present embodiment is present as boron nitride on the surface of the metal particle. Nitrogen is little contained in the metal raw material powder; however, most of boron contained in the metal particle reacts with nitrogen contained in the atmosphere such that boron nitride is formed in the latter process of the heat treatment step, and thus nitrogen taken from the atmosphere is contained in the soft magnetic metal powder. A mass ratio (N/B) of nitrogen to boron constituting boron nitride is 14.0/10.8=1.30. Hence, the amount of nitrogen contained in the soft magnetic metal powder is 100 mass % to 150 mass % of the amount of boron in the soft magnetic metal powder.

2.5. Roundness of Particle

The above-described heat treatment step is performed, and thereby it is possible to obtain powder, of which the roundness of cross sections of 80% or more of the soft magnetic metal particles is 0.80 or higher, of the soft magnetic metal particles constituting the soft magnetic metal powder. When the conditions of the heat treatment step are adjusted, it is possible to obtain powder, of which the roundness of the cross sections of 90% or more of the soft magnetic metal particles is 0.80 or higher. In other words, it is possible to obtain soft magnetic metal powder containing particles with a true spherical shape or a shape that approximates to the true spherical shape.

A method of measuring the roundness may be as follows. First, the obtained soft magnetic metal powder is mounted and fixed in a cold mounting resin, and mirror polishing is performed such that a cross section of a particle constituting the powder is exposed. Subsequently, the particle having the exposed cross section is observed by an optical microscope, a scanning electron microscope (SEM), or the like, and an observation image is subjected to an image processing such that the roundness of the particle is measured. The number of particles to be measured is preferably 20 or more and more preferably 100 or more. In addition, it is preferable to use Wadell roundness as the roundness. That is, a diameter of a circle having an area equal to a projection area of a cross section of a particle with respect to a diameter of a circumscribed circle to the cross section of the particle is evaluated. In a case of a true circle, the Wadell roundness is 1. Hence, as the Wadell roundness approximates to 1, the shape of the cross section of the particle also approximates to the true circle.

In the present embodiment, metal raw material powder obtained by improving the shape of the metal raw material particle is not used. The metal raw material powder is subjected to the heat treatment, and thereby the shape of the particle after the heat treatment is improved. Hence, even when the shape of the metal raw material particle is irregular, it is possible to obtain particles with the true spherical shape or a shape that approximates to the true spherical shape after the heat treatment.

2.6. Crystal Grain Size of Particle

The above-described heat treatment step is performed, and thereby it is possible to obtain the soft magnetic metal powder including 85% or more and, preferably, 90% or more of the metal particles having one crystal grain, of the metal particles constituting the soft magnetic metal powder. A crystal grain boundary that hinders a magnetic domain wall from moving is not present in the metal particle having one crystal grain, and thus it is possible to obtain the soft magnetic metal powder having low coercivity.

A method of observing the crystal grain may be as follows. First, the obtained soft magnetic metal powder is mounted and fixed in a cold mounting resin, and mirror polishing is performed such that the cross section of the particle constituting the powder is exposed. Subsequently, it is possible to observe a crystal grain boundary by etching the particle having the exposed cross section with an etchant such as Nital (ethanol+1% of nitric acid). It is possible to perform observation by using the optical microscope or the scanning electron microscope (SEM). Observation conditions of the crystal grain boundary may be determined by using polycrystalline alloy powder having similar components in advance, and the observation may be performed in the conditions in accordance thereto. At least 20 and, preferably, 100 or more cross sections of the metal particles prepared as described above may be observed, metal particles in which the crystal grain boundary is not observed may be counted as metal particles having one crystal grain, and a ratio of the number of the metal particles to the number of observed metal particles may be obtained.

2.7. Particle Size Distribution

The above-described heat treatment step is performed, and thereby it is possible to obtain soft magnetic metal powder having a small standard deviation of a particle size distribution of the metal particles. In the present embodiment, the particle size distribution of the soft magnetic metal powder means a particle size distribution obtained from particle sizes based on volume which is calculated by using a laser diffraction scattering method. In the particle size distribution, a standard deviation σ can be represented by Equations 1 to 3.

$$\text{Standard Deviation } \sigma=(\sigma 1+\sigma 2)/2 \quad \text{Equation 1}$$

$$\sigma 1=\ln(d50/d16)/ \quad \text{Equation 2}$$

$$\sigma 2=\ln(d84/d50)/ \quad \text{Equation 3}$$

d16, d50, and d84 represents a 16% cumulative particle size, a 50% cumulative particle size, and an 84% cumulative particle size in the particle size distribution, respectively.

A flake of boron nitride which is detached in the spheroidization process of the heat treatment step is contained in the soft magnetic metal powder of the present embodiment. Since the flake of boron nitride is smaller than the size of the metal particle, the flake is detected as a fine particle when the particle size distribution is measured. When the particle size distribution of the metal particles of the soft magnetic metal powder is substantively measured, it is preferable that a measurement is performed after a separation operation of the above-mentioned boron nitride removing step is performed such that flakes of detached boron nitride are removed. Note that boron nitride adhering to the metal particle does not influence the particle size distribution significantly.

The above-described heat treatment step is performed so as to produce the soft magnetic metal powder, and thereby the standard deviation $\sigma((\sigma 1+\sigma 2)/2)$ of the particle size distribution of the soft magnetic metal powder obtained after removing the flakes of detached boron nitride is 0.65 or less. In other words, the particle size distribution is sharp. a dust core having a highly relative density and a small core loss can be produced by using a powder having a low standard deviation.

3. Soft Magnetic Metal Dust Core

Since the soft magnetic metal powder obtained in the present invention has the low coercivity, the core loss decreases in a case where the soft magnetic metal powder is used in the soft magnetic metal dust core. As a method for producing the soft magnetic metal dust core, a general production method except for using the soft magnetic metal powder obtained described above as the soft magnetic metal powder can be adopted. An example of the method is as follows.

First, a resin is mixed with the soft magnetic metal powder obtained described above such that granules are prepared. As the resin, a known resin such as an epoxy resin or a silicone resin can be used. Preferably, the resin has a shape retaining property during molding and an electrical insulation property and is capable of coating the particle surface of the soft magnetic metal powder uniformly. A press mold having a desired shape is filled with the obtained granules, and press molding is performed such that a molded body is obtained. It is possible to appropriately select molding pressure depending on a composition or a desired forming density of the soft magnetic metal powder, and the molding pressure is in a range of substantially 600 MPa to 1600 MPa. A lubricant may be used as necessary. The obtained molded body is thermally hardened so as to become the soft magnetic metal dust core. Otherwise, the heat treatment for removing strain during molding is performed such that the soft magnetic metal dust core is produced. The heat treatment is desirably performed at a temperature of 500° C. to 800° C. in the non-oxidizing atmosphere such as a nitrogen atmosphere or an argon atmosphere.

As described above, the embodiment of the present invention is described; however, the present invention is not limited to the embodiment described above at all, and various modifications may be performed within a range of the present invention.

Example

Hereinafter, in an example, the present invention will be described further in detail. However, the present invention is not limited to the following examples.

Experiment 1

First, the metal raw material powder was prepared by the water-atomization method such that a composition of the metal raw material particle was a composition shown in Table 1 and amounts of boron and oxygen contained in the metal raw material particle were values shown in Table 1. The particle size distributions of the produced metal raw material powder were the same as each other.

The carbon source substance shown in Table 1 was added to the produced metal raw material powder by an amount shown in Table 1 such that the mixed powder was produced. Carbon black was used as the carbon source substance, a solution obtained by dispersing carbon black in acetone and the metal raw material powder were mixed and dried, and thereby simplified coating was performed by attaching the carbon black to the surfaces of the particles constituting the metal raw material powder. In addition, a sample 7 was obtained by using polyvinyl alcohol (PVA) as the carbon source substance. An amount of carbon derived from the PVA was estimated as an effective amount of carbon based on a weight of a residue obtained after a heat treatment on PVA put in a container with a lid at 750° C. in the nitrogen atmosphere, and an amount of carbon with respect to an amount of oxygen shown in Table 1 was calculated by using the effective amount of carbon.

A crucible made of alumina was filled with the produced mixed powder and was placed in a tubular furnace, and the heat treatment step was performed in a heat treatment temperature condition and in a heat treatment atmosphere condition shown in Table 1. Note that, in sample numbers 1 and 2, the carbon source substance was not added, and the heat treatment step was not performed either. In other words, the sample numbers 1 and 2 represent water-atomized powder.

TABLE 1

| | Metal raw material powder | | | | | |
|---|---|---|---|---|---|---|
| | | Composition | | | | |
| Sample number | Production method | Fe [mass %] | Si [mass %] | B [mass %] | Cr [mass %] | O [mass %] |
| 1 | Water-atomization | Bal. | 4.5 | — | — | 0.240 |
| 2 | Water-atomization | Bal. | 4.5 | 1.0 | — | 0.275 |
| 3 | Water-atomization | Bal. | 4.5 | — | — | 0.140 |
| 4 | Water-atomization | Bal. | 4.5 | — | — | 0.140 |
| 5 | Water-atomization | Bal. | 4.5 | 1.0 | — | 0.275 |
| 6 | Water-atomization | Bal. | 4.5 | 1.0 | — | 0.275 |
| 7 | Water-atomization | Bal. | 4.5 | 1.0 | — | 0.275 |
| 8 | Water-atomization | Bal. | 4.5 | 1.0 | — | 0.275 |
| 9 | Water-atomization | Bal. | 4.5 | 1.0 | — | 0.275 |
| 10 | Water-atomization | Bal. | 4.5 | 1.0 | — | 0.275 |
| 11 | Water-atomization | Bal. | 4.5 | 1.0 | — | 0.275 |
| 12 | Water-atomization | Bal. | 4.5 | 1.0 | — | 0.275 |
| 13 | Water-atomization | Bal. | 4.5 | 1.0 | — | 0.275 |
| 14 | Water-atomization | Bal. | 4.5 | 1.0 | — | 0.275 |
| 15 | Water-atomization | Bal. | 4.5 | 1.0 | — | 0.275 |
| 16 | Water-atomization | Bal. | 6.5 | 0.6 | — | 0.240 |
| 17 | Water-atomization | Bal. | 6.5 | 0.8 | — | 0.310 |
| 18 | Water-atomization | Bal. | 6.5 | 1.2 | — | 0.350 |
| 19 | Water-atomization | Bal. | 5.0 | 1.0 | 2.0 | 0.240 |
| 20 | Water-atomization | Bal. | 3.0 | 1.5 | — | 0.220 |
| 21 | Water-atomization | Bal. | 3.0 | 1.8 | — | 0.290 |
| 22 | Water-atomization | Bal. | 3.0 | 2.2 | — | 0.360 |

| | Mixture step Carbon source substance | | | | Heat treatment step | | |
|---|---|---|---|---|---|---|---|
| Sample number | Type | Amount of additive [mass %] | Coating | Amount of Carbon with respect to amount of oxygen [%] | Temperature [° C.] | Atmosphere | Form |
| 1 | None | 0.00 | — | 0 | — | Nitrogen | Powder |
| 2 | None | 0.00 | — | 0 | — | Nitrogen | Powder |
| 3 | None | 0.00 | — | 0 | 1350 | Nitrogen | Sintered |
| 4 | Carbon | 0.30 | Coating | 214 | 1350 | Nitrogen | Sintered |
| 5 | None | 0.00 | — | 0 | 1350 | Nitrogen | Powder |
| 6 | Carbon | 0.30 | Coating | 109 | 1350 | Nitrogen | Powder |
| 7 | PVA | 3.00 | None | 55 | 1350 | Nitrogen | Powder |
| 8 | Carbon | 0.05 | Coating | 18 | 1350 | Nitrogen | Powder |
| 9 | Carbon | 0.10 | Coating | 36 | 1350 | Nitrogen | Powder |
| 10 | Carbon | 0.20 | Coating | 73 | 1350 | Nitrogen | Powder |
| 11 | Carbon | 0.40 | Coating | 145 | 1350 | Nitrogen | Powder |
| 12 | Carbon | 0.55 | Coating | 200 | 1350 | Nitrogen | Powder |
| 13 | Carbon | 0.30 | Coating | 109 | 1200 | Nitrogen | Powder |
| 14 | Carbon | 0.30 | Coating | 109 | 1350 | Argon | Sintered |
| 15 | Carbon | 0.30 | Coating | 109 | 1350 | Air | Sintered |
| 16 | Carbon | 0.40 | Coating | 167 | 1320 | Nitrogen | Powder |
| 17 | Carbon | 0.40 | Coating | 129 | 1300 | Nitrogen | Powder |

TABLE 1-continued

| | | | | | | | |
|---|---|---|---|---|---|---|---|
| 18 | Carbon | 0.40 | Coating | 114 | 1270 | Nitrogen | Powder |
| 19 | Carbon | 0.20 | Coating | 83 | 1350 | Nitrogen | Powder |
| 20 | Carbon | 0.30 | Coating | 136 | 1380 | Nitrogen | Powder |
| 21 | Carbon | 0.30 | Coating | 103 | 1380 | Nitrogen | Powder |
| 22 | Carbon | 0.30 | Coating | 83 | 1380 | Nitrogen | Powder |

Forms of the soft magnetic metal powder after the heat treatment step are shown in Table 1. As shown in Table 1, in sample numbers 3, 4, 14, and 15, the particles contained in the powder were sintered in each other.

For samples 1 and 2 of the metal raw material powder, and samples 5 to 13, and 16 to 22 of the soft magnetic metal powder in which forms of the soft magnetic metal powder after the heat treatment was powder form, a ratio of particles having the roundness of 0.80 or higher and a ratio of particles having one crystal grain were measured.

The powder was fixed in a cold mounting resin, and the mirror polishing is performed such that cross sections of particles were exposed. The obtained cross section was observed by the scanning electron microscope (SEM), subsequently 50 cross sections of particles were randomly selected, the roundness thereof was measured, and a ratio of particles having the roundness of 0.80 or higher was calculated. The Wadell roundness was used as the roundness. Results are shown in Table 2.

In addition, the cross sections of the particles subjected to the mirror polishing were etched with Nital, then, 50 cross sections of particles were randomly selected, whether or not the crystal grain boundary was present in the particles was evaluated, and thus a ratio of particles having one crystal grain was calculated. Results are shown in Table 2.

For samples 1, 2, 5 to 13, and 16 to 22, the coercivity was measured as follows. 20 mg of the soft magnetic metal powder and paraffin were put in a plastic case having a size of ϕ 6 mm×5 mm, then, the soft magnetic metal powder was fixed by melting and solidifying paraffin and the coercivity was measured by a coercimeter (K-HC 1000 type, manufactured by TOHOKU STEEL Co., Ltd.). A measurement magnetic field was 150 kA/m. Results are shown in Table 2.

For samples 1, 2, 5 to 13, and 16 to 22, the amount of boron of the powder was measured by the ICP. Results are shown in Table 2. In addition, the amount of oxygen of the powder was measured by an oxygen analyzer (TC600, manufactured by LECO CORPORATION). Results are shown in Table 2. In addition, the amount of carbon of the powder was measured by a carbon analyzer (CS-600, manufactured by LECO CORPORATION). Results are shown in Table 2.

TABLE 2

| | Soft magnetic metal powder | | | | | | | | | | | | | |
|---|---|---|---|---|---|---|---|---|---|---|---|---|---|---|
| | | Ratio of particles having roundness of | Ratio of particles having one | Amount of oxygen of | Amount of carbon of | Amount of boron of | Particle size distribution | | | | | | | |
| Sample | Coercivity | 0.8 or higher | crystal grain | powder | powder | powder | d10 | d16 | d50 | d84 | d90 | Standard deviation | | |
| number | Hc(A/m) | [%] | [%] | [mass %] | [mass %] | [mass %] | [μm] | [μm] | [μm] | [μm] | [μm] | σ1 | σ2 | σ |
| 1 | 460 | 62 | 0 | 0.28 | 0.006 | 0.0 | 7 | 10 | 23 | 46 | 57 | 0.90 | 0.67 | 0.78 |
| 2 | >1600 | 66 | 0 | 0.28 | 0.006 | 1.0 | 7 | 10 | 23 | 46 | 57 | 0.90 | 0.67 | 0.78 |
| 3 | — | — | — | — | — | — | — | — | — | — | — | — | — | — |
| 4 | — | — | — | — | — | — | — | — | — | — | — | — | — | — |
| 5 | 280 | 66 | 80 | 0.20 | 0.006 | 1.0 | 8 | 10 | 23 | 49 | 59 | 0.80 | 0.74 | 0.77 |
| 6 | 130 | 94 | 100 | 0.03 | 0.180 | 1.0 | 15 | 18 | 32 | 53 | 61 | 0.56 | 0.49 | 0.53 |
| 7 | 170 | 96 | 100 | 0.02 | 0.150 | 1.0 | 12 | 15 | 29 | 50 | 58 | 0.66 | 0.54 | 0.60 |
| 8 | 240 | 80 | 86 | 0.24 | 0.010 | 1.0 | 10 | 15 | 32 | 60 | 66 | 0.78 | 0.61 | 0.70 |
| 9 | 200 | 90 | 90 | 0.15 | 0.016 | 1.0 | 11 | 15 | 30 | 54 | 63 | 0.69 | 0.59 | 0.64 |
| 10 | 160 | 92 | 100 | 0.02 | 0.050 | 1.0 | 12 | 17 | 32 | 53 | 60 | 0.65 | 0.50 | 0.57 |
| 11 | 190 | 100 | 100 | 0.02 | 0.250 | 1.0 | 17 | 22 | 38 | 55 | 60 | 0.53 | 0.38 | 0.45 |
| 12 | 280 | 98 | 100 | 0.02 | 0.350 | 1.0 | 14 | 22 | 39 | 60 | 67 | 0.56 | 0.44 | 0.50 |
| 13 | 530 | 68 | 0 | 0.23 | 0.280 | 1.0 | 8 | 10 | 23 | 49 | 59 | 0.80 | 0.74 | 0.77 |
| 14 | — | — | — | — | — | — | — | — | — | — | — | — | — | — |
| 15 | — | — | — | — | — | — | — | — | — | — | — | — | — | — |
| 16 | 130 | 90 | 94 | 0.06 | 0.290 | 0.6 | 15 | 21 | 37 | 58 | 65 | 0.57 | 0.45 | 0.51 |
| 17 | 120 | 94 | 100 | 0.01 | 0.220 | 0.8 | 14 | 20 | 37 | 58 | 66 | 0.63 | 0.45 | 0.54 |
| 18 | 170 | 86 | 90 | 0.08 | 0.250 | 1.2 | 12 | 17 | 33 | 55 | 64 | 0.66 | 0.51 | 0.59 |
| 19 | 220 | 96 | 100 | 0.09 | 0.120 | 1.0 | 14 | 19 | 34 | 54 | 61 | 0.60 | 0.47 | 0.53 |
| 20 | 220 | 95 | 100 | 0.04 | 0.220 | 1.5 | 14 | 19 | 34 | 54 | 61 | 0.60 | 0.47 | 0.53 |
| 21 | 250 | 85 | 100 | 0.05 | 0.180 | 1.8 | 12 | 17 | 33 | 54 | 60 | 0.66 | 0.49 | 0.58 |
| 22 | 330 | 82 | 95 | 0.10 | 0.150 | 2.2 | 9 | 14 | 28 | 53 | 60 | 0.69 | 0.64 | 0.67 |

In the samples 6 to 12 and 16 to 22, the carbon source substance and the raw material powder having the plurality of raw material particles including iron, silicon, and boron were mixed; and the obtained mixed powder was subjected to the heat treatment in the non-oxidizing atmosphere containing nitrogen at a heat treatment temperature of 1,250° C. or higher. In this manner, it was confirmed that the soft magnetic metal powder including lots of metal particles which had high roundness and one crystal grain and having the low coercivity of 350 A/m or lower were obtained.

In addition, in the samples 6, 7, 9 to 11, and 16 to 21, since the amount of boron of the soft magnetic metal powder is 0.01 to 2.0 mass %, the amount of carbon of the soft magnetic metal powder is 0.010 to 0.300 mass %, boron nitride is formed on the surface of the metal particle, the roundness of 80% or more of metal particles is 0.80 or higher, and 85% or more of metal particles have one crystal grain, and thus it was confirmed that the soft magnetic metal powder has particularly low coercivity of 250 A/m or lower.

Further, in the samples 6, 7, 10, and 11, since the amount of oxygen of the soft magnetic metal powder is 0.100 mass % or less, it was confirmed that the soft magnetic metal powder has much lower coercivity than that of the sample 9 having the same amount of silicon.

Further, for the sample 6, the amount of boron in the particle and the amount of carbon in the particle were measured as follows. The obtained soft magnetic metal powder was ground by a ball mill, acetone was added thereto and then the powder and the acetone were stirred. Boron nitride and fine particles of carbon attached to the surfaces of the metal particles were caused to suspend in the acetone, then, supernatant acetone was separated and removed, and thereby the soft magnetic metal powder after the heat treatment, from which boron nitride and carbon were removed, was obtained.

For the soft magnetic metal powder with grinding time being changed by one hour, two hours, thirteen hours, and eighteen hours, the amount of nitrogen, the amount of boron, and the amount of carbon were measured.

The amount of nitrogen in the particle was measured by a nitrogen analyzer (TC600, manufactured by LECO CORPORATION) in the same manner as the amount of nitrogen of the powder. The amount of boron in the particle was measured by the ICP in the same manner as the amount of boron of the powder. The amount of carbon in the particle was measured by a carbon analyzer (CS-600, manufactured by LECO CORPORATION) in the same manner as the amount of carbon of the powder.

Removal amount of boron nitride increases as the grinding time is lengthened, and thus the amount of boron nitride in the powder decreases. Therefore, both of the amount of nitrogen and the amount of boron in the powder decrease; however, the amount of boron in the particle does not change. Thus, a correlation between the amount of nitrogen and the amount of boron was calculated, then, the amount of boron when the amount of nitrogen was 0 was extrapolated to the correlation, and an obtained value was regarded as the amount of boron in the particle and was 0.009 mass %.

In addition, carbon attached to the surface decreased as the grinding time was lengthened. Therefore, although the amount of carbon present outside the particle decreases, it approaches a certain value, and thus a convergence value was regarded as the amount of carbon in the particle, and the amount of carbon in the particle was 0.08 mass %.

For samples 1 and 2 of the metal raw material powder, and samples 5 to 13, and 16 to 22 of the soft magnetic metal powder in which the forms of the soft magnetic metal powder after the heat treatment was powder form, the particle size distribution of the powder and the standard deviation thereof were measured.

As described above, detached boron nitride is contained in the soft magnetic metal powder after the heat treatment, and thus fine powder derived from the detached boron nitride is detected. Therefore, the particle size distribution of the soft magnetic metal powder changes. In order to measure the particle size distribution of the metal particles contained in the soft magnetic metal powder, first, the detached boron nitride was removed in the boron nitride removing step described below.

The soft magnetic metal powder after the heat treatment was put in a container, acetone was added thereto, and the powder and the acetone were stirred, the detached boron nitride was caused to suspend in the acetone, then, only the metal particles were settled out by using a magnet, and cloudy acetone containing boron nitride was removed. The above operation was repeated until cloudiness disappears. The particle size distribution of the soft magnetic metal powder, from which detached boron nitride is removed, was measured by using HELOS & RODOS (manufactured by Japan Laser Corp.) as a laser diffraction-type particle size distribution measuring apparatus, and a particle size distribution and a standard deviation thereof were calculated from the obtained particle size distribution. Results are shown in Table 2.

Note that the magnet was put into the cloudy supernatant acetone, then the acetone was stirred, and a weight of the metal particles attached to the magnet was measured. As a result, the weight of the metal particles was 1 mass % or less with respect to the weight of the soft magnetic metal powder put in the container, and thus the metal particles contained in the soft magnetic metal powder after the heat treatment and the metal particles after the boron nitride removing step of removing the detached boron nitride are considered to be substantially the same as each other.

In the samples 6 to 12 and 16 to 22, the standard deviation a of the particle size distribution of the soft magnetic metal powder was 0.70 or lower, and thus it was confirmed that the soft magnetic metal powder having a smaller amount of fine powder is obtained, compared to water-atomized powder of the raw material ($\sigma$=0.78). In addition, since a particle size of d90% of coarse powder is 58 μm to 67 μm, and the particle size little changes or has only an increase of 20% or less, compared to the water-atomized powder of the raw material (d90%=57 μm), therefore there is no increase in eddy current loss.

Further, in the samples 6, 7, 9 to 11, and 16 to 21, the standard deviation $\sigma$ of the particle size distribution of the soft magnetic metal powder was 0.65 or lower, and thus it was confirmed that the soft magnetic metal powder having a much smaller amount of fine powder is obtained.

In addition, in the samples 5 to 13 and 16 to 22, the cloudy supernatant acetone was dried, and obtained white powder was measured by an XRD. As a result, it was confirmed that boron nitride was formed. An external appearance of the powder after the heat treatment was observed by the SEM, and then it was confirmed that boron nitride was attached to the surface of metal particles.

Experiment 2

The boron nitride removing step of removing detached boron nitride and boron nitride attached to the surface of the metal particles was performed on the soft magnetic metal powder of the sample 6. The soft magnetic metal powder after the heat treatment, zirconia media, and ethanol as a solvent were put in the ball mill, and a grinding process was performed for 0.5 hours (sample 6-2), 1.0 hour (sample 6-3), and 3 hours (sample 6-4). As a result, ethanol became cloudy, and a suspension solution was obtained. Ethanol was added to the obtained suspension solution, the metal particles after the heat treatment and the supernatant suspension solution were subjected to magnetic separation from each other, and the soft magnetic metal powder after the heat treatment, from which boron nitride is removed, was obtained.

For the soft magnetic metal powder obtained after removing the boron nitride, the roundness, the ratio of the metal particles having one crystal grain, the amount of oxygen, the amount of carbon, and the amount of boron of the soft magnetic metal powder, and the coercivity were measured in the same manner as the sample 6 described above, and results are shown in Table 3. As is clear from Table 3, even after performing the boron nitride removing step, it was confirmed that the roundness was high, lots of metal particles having one crystal grain were present, and low coercivity of 300 A/m or lower was obtained.

TABLE 3

| Sample number | Soft magnetic metal powder: Coercivity Hc(A/m) | Ratio of particles having roundness of 0.80 or higher [%] | Ratio of particles having one crystal grain [%] | Amount of oxygen of powder [mass %] | Amount of carbon of powder [mass %] | Amount of boron of powder [mass %] |
|---|---|---|---|---|---|---|
| 6-2 | 150 | 94 | 100 | 0.05 | 0.120 | 0.7 |
| 6-3 | 180 | 93 | 100 | 0.05 | 0.100 | 0.4 |
| 6-4 | 290 | 90 | 100 | 0.07 | 0.090 | 0.1 |

Figure 8A:
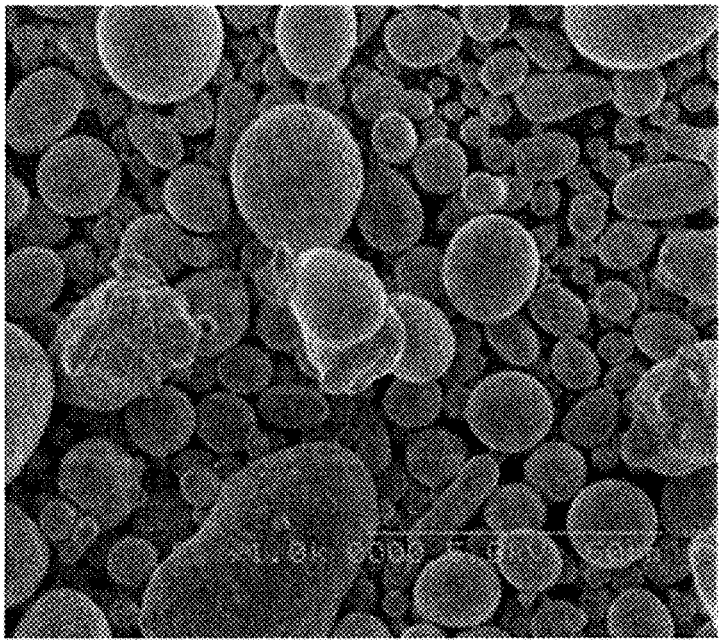
FIG. 8A is an SEM image illustrating an external appearance of powder according to a sample number 2 in an example of the present invention.
Figure 8B:
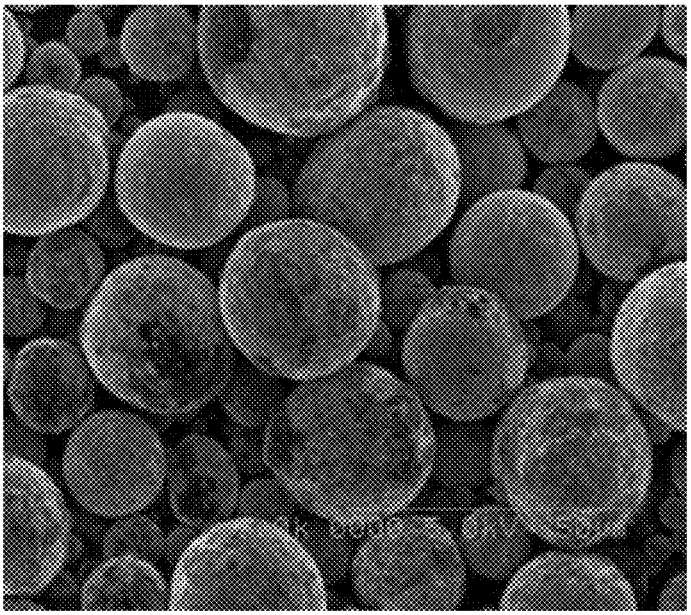
FIG. 8B is an SEM image illustrating an external appearance of powder according to a sample number 6-2 in an example of the present invention.

In addition, FIGS. 8A and 8B show SEM pictures of external appearances of the metal raw material powder (sample 2) and the soft magnetic metal powder (sample 6-2) after the boron nitride removing step of the embodiment. As is clear from the FIGS, even in a case where a raw material powder containing the particles of which shape is irregular, and containing much fine powder is used, the soft magnetic metal powder having the high sphericity and a small amount of fine powder can be obtained, according to the production method of the present embodiment.

Experiment 3

The dust cores were produced by using the soft magnetic metal powder of samples 1, 6, and 6-2 to 6-4 and are numbered samples 2-1 to 2-5. A silicone resin was added by 1.0 mass % in terms of 100 mass % of the soft magnetic metal powder and was kneaded by a kneader so as to prepare granules. A toroidal press mold having an outer diameter of 17.5 mm and an inner diameter of 11.0 mm was filled with the granules and the granules was pressed at a molding pressure of 1,180 MPa, and a molded body was obtained. A weight of the core was 5 g. The obtained molded body was subjected to the heat treatment in a belt furnace at 750° C. for 30 min in the nitrogen atmosphere, and thereby the dust core was obtained.

For the obtained dust core, the permeability and the core loss were evaluated. The permeability and the core loss were measured by using a BH analyzer (SY-8258 manufactured by IWATSU ELECTRIC CO., LTD.) in conditions of a frequency of 50 kHz and measured magnetic flux density of 50 mT, and results are shown in Table 4. In addition, inductance of the soft magnetic metal dust core at a frequency of 100 kHz was measured by using an LCR meter (4284A manufactured by Agilent Technologies) and a DC bias power supply (42841A manufactured by Agilent Technologies), and the permeability of the soft magnetic metal dust core was calculated from the inductance. The inductance was measured in a case where a DC superimposed magnetic field was 0 A/m and a case where the DC superimposed magnetic field was 8,000 A/m, and the permeabilities of the cases were shown in Table 4 as μ (0 A/m) and μ (8 kA/m), respectively. In addition, a change rate was calculated and was shown in Table 4.

TABLE 4

| Sample number | Dust core: Soft magnetic metal powder | Pcv [kW/m$^3$] | μ (0 A/m) | μ (8 kA/m) | μ Change rate |
|---|---|---|---|---|---|
| 2-1 | 1 | 192 | 111 | 32 | −71% |
| 2-2 | 6 | 118 | 49 | 41 | −16% |

TABLE 4-continued

| Sample number | Dust core: Soft magnetic metal powder | Pcv [kW/m$^3$] | μ (0 A/m) | μ (8 kA/m) | μ Change rate |
|---|---|---|---|---|---|
| 2-3 | 6-2 | 110 | 68 | 47 | −31% |
| 2-4 | 6-3 | 106 | 76 | 45 | −41% |
| 2-5 | 6-4 | 100 | 98 | 42 | −57% |

In Table 4, when the sample 2-1 was compared with the samples 2-2 to 2-5, it was confirmed that the core loss of the soft magnetic metal dust core using the soft magnetic metal powder of the present invention can be improved, and the soft magnetic metal dust core has a low change rate of the permeability when DC magnetic fields are superimposed and good DC superimposition characteristics.

What is claimed is:

1. A soft magnetic metal powder comprising metal particles including iron, silicon, boron, carbon, and oxygen, wherein an amount of boron contained in 100 mass % of the soft magnetic metal powder is 0.010 mass % or more and 2.0 mass % or less, an amount of carbon contained in 100 mass % of the soft magnetic metal powder is 0.120 mass % or more and 0.350 mass % or less, an amount of oxygen contained in 100 mass % of the soft magnetic metal powder is 0.1000 mass % or less, the amount of carbon is 3.125 times or higher than the amount of oxygen, boron nitride is formed on a surface of the metal particles, a roundness of 80% or more of the metal particles is 0.80 or higher, and 85% or more of the metal particles consist of one crystal grain.

2. The soft magnetic metal powder according to claim 1, wherein an amount of chromium contained in 100 mass % of the soft magnetic metal powder is 1 mass % or more and 10 mass % or less.

3. The soft magnetic metal powder according to claim 1, wherein, when a total amount of iron and nickel contained in the soft magnetic metal powder is 100 mass %, an amount of nickel is 40 mass % or more and 80 mass % or less.

4. The soft magnetic metal powder according to claim 1, wherein an amount of carbon contained in the metal particles is 0.120 mass % or more and 0.150 mass % or less.

5. A soft magnetic metal dust core comprising:

the soft magnetic metal powder according to claim 1.

* * * * *